United States Patent [19]

Kendall et al.

[11] 4,204,829

[45] May 27, 1980

[54] CATALYTIC COMBUSTION PROCESS AND SYSTEM

[75] Inventors: Robert M. Kendall, Sunnyvale; John P. Kesselring, Mountain View; Wayne V. Krill, Sunnyvale, all of Calif.

[73] Assignee: Acurex Corporation, Mountain View, Calif.

[21] Appl. No.: 893,575

[22] Filed: Apr. 5, 1978

[51] Int. Cl.[2] ..... B01J 29/00

[52] U.S. Cl. ..... 431/7; 431/328; 122/4 D; 422/200; 422/193

[58] Field of Search ..... 122/4 D; 431/7, 2, 328; 422/173, 200, 190, 193; 60/39.69 A, 39.02, 39.82 C, 298

[56] References Cited

U.S. PATENT DOCUMENTS

| | | | |
|---|---|---|---|
| 2,095,065 | 10/1937 | Hays | 431/7 |
| 2,856,905 | 10/1958 | Bowen | 122/4 D |
| 2,878,789 | 3/1959 | Huet | 122/4 D |
| 3,109,715 | 11/1963 | Johnson et al. | 60/298 |
| 3,910,042 | 10/1975 | Yuge et al. | 60/298 |
| 3,928,961 | 12/1975 | Pfefferle | 60/39.69 A |
| 3,975,900 | 8/1976 | Pfefferle | 60/39.69 A |
| 4,021,185 | 5/1977 | Hindin et al. | 431/7 |
| 4,087,962 | 5/1978 | Beremand et al. | 431/7 |
| 4,088,435 | 5/1978 | Hindin et al. | 431/7 |
| 4,107,922 | 8/1978 | Wössner | 60/298 |

*Primary Examiner*—Ira S. Lazarus
*Assistant Examiner*—Magdalen Moy
*Attorney, Agent, or Firm*—Flehr, Hohbach, Test, Albritton & Herbert

[57] ABSTRACT

A process and system of apparatus for stoichiometrically combusting fuel and air reactants. A stream of the reactants is directed through an upstream zone for combustion about cylinders comprised of a catalytic material. A plurality of heat sink conduits are spaced about the cylinders for absorbing radiant energy from the cylinders, and a coolant medium is directed through the conduits for extracting thermal energy at a controlled rate. Products from the upstream zone are directed through a combustor in a downstream zone for adiabatic combustion, and products from the combustor are directed in heat exchange relationship with a coolant medium which extracts residual energy from the stream.

17 Claims, 9 Drawing Figures

CATALYTIC COMBUSTION PROCESS AND SYSTEM

The invention described herein was made in the course of, or under, a contract with the Environmental Protection Agency.

CROSS-REFERENCE TO RELATED APPLICATION

Reference is made to copending application Ser. No. 799,948, filed May 24, 1977 now U.S. Pat. No. 4,154,568 by the Assignee hereof and entitled Catalytic Combustion Process and Apparatus.

BACKGROUND OF THE INVENTION

This invention relates in general to catalytic combustion processes, e.g. for use in water tube boiler applications.

The use of catalysts in the place of conventional burners for promoting hydrocarbon oxidation reaction provides advantages in the control of emissions. Most catalytic combustors of conventional design operate at near-adiabatic conditions. Stoichiometric operation of these conventional catalytic combustors is precluded by the combustor material because the temperature limits of these materials must be maintained far below the stoichiometric flame temperature. The result is that operation of conventional off-stoichiometric catalytic combustors can result in inefficient systems. If the system employs a single stage combustor, then to keep the flame temperature down to acceptable levels air or fuel, or both, must be added. Where a multiple stage combustor is operated with fuel-rich combustion at a lower temperature in the first stage then secondary air must be added for the next combustion stage. In a Flue Gas Recirculation (FGR) System a portion of the exhaust stream is recirculated into the combustor for purposes of increasing system efficiency.

OBJECTS AND SUMMARY OF THE INVENTION

It is a general object of the invention to provide a new and improved combustion process and system having relatively high combustion efficiency and optimum control of emissions.

Another object is to provide a catalytic combustor having a stage in which the reactants are stoichiometrically combusted, and in which the combustor is capable of operating through a wide range of stoichiometric fuel/air mixtures.

Another object is to provide a catalytic combustor in which a stoichiometric fuel/air mixture is combusted in one zone with combustion being completed in an adiabatic combustor zone, and in which residual energy is recovered from the products exhausting from the adiabatic combustor.

The invention in summary includes a process in which a mixture of fuel and oxidizer reactants is directed through a zone in which a surface-active body is disposed for stoichiometrically combusting the reactants. Energy from the body is radiated to heat sinks at a rate which prevents the temperature of the body from exceeding a predetermined limit. The system of apparatus includes a combustor which forms a flow passage for confining a stream of the reactants. The surface-active bed within the passage comprises a plurality of cylinders having catalytic surfaces. Conduits spaced in an array about each of the cylinders provide the heat sinks for absorbing radiant energy from the cylinders. A coolant fluid is circulated in heat exchange relationship through the conduits for extracting thermal energy.

The foregoing and additional objects and features of the invention will appear from the following specification in which the embodiments of the invention have been set forth in detail in conjunction with the accompanying drawings.

DESCRIPTION OF THE PREFERRED EMBODIMENTS

Figure 1:
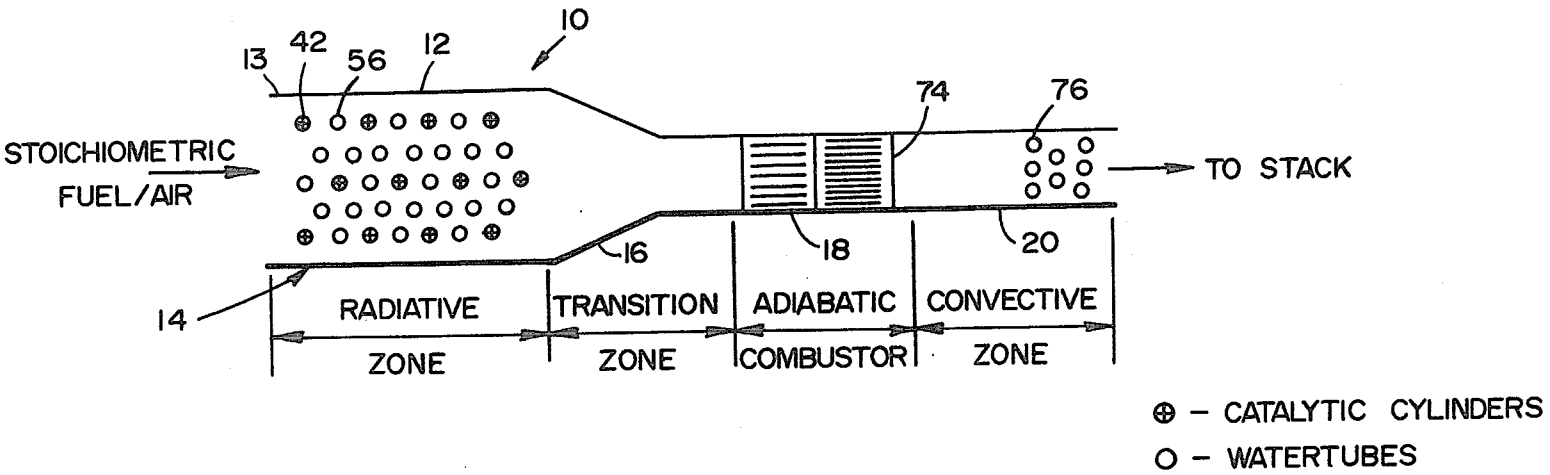
FIG. 1 is a schematic diagram of a system of apparatus incorporating the invention.

In the drawings FIG. 1 illustrates schematically at 10 a system of apparatus incorporating the invention. The system includes a housing 12 forming a flow passage for directing an incoming stream of fuel/air reactants from an inlet 13 serially through a radiative zone 14, a transition zone 16, an adiabatic combustor zone 18 and a convective zone 20 which discharges to a stack, not shown.

Figure 2:
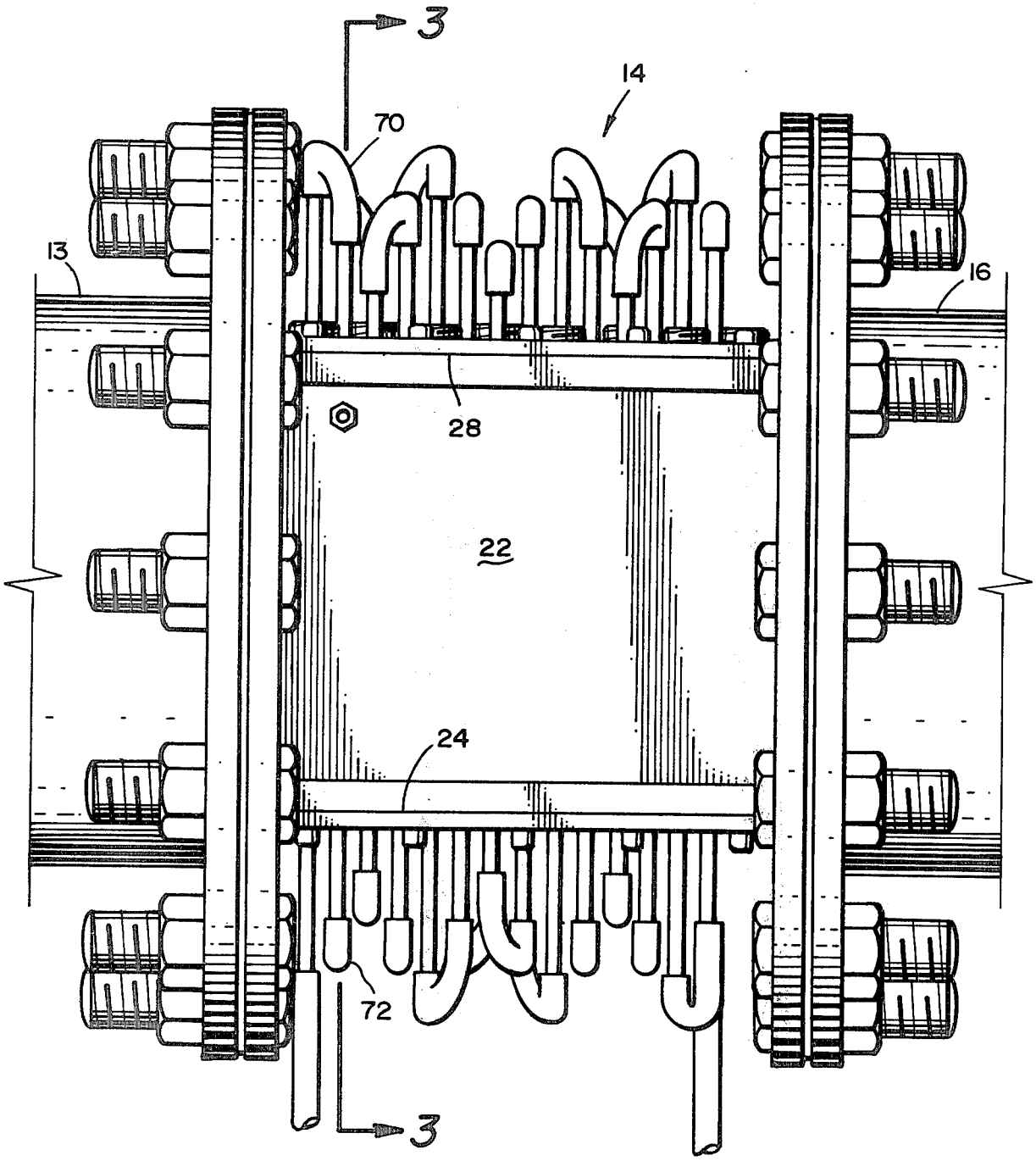
FIG. 2 is a side elevational view of the radiative zone in the apparatus of FIG. 1.
Figure 3:
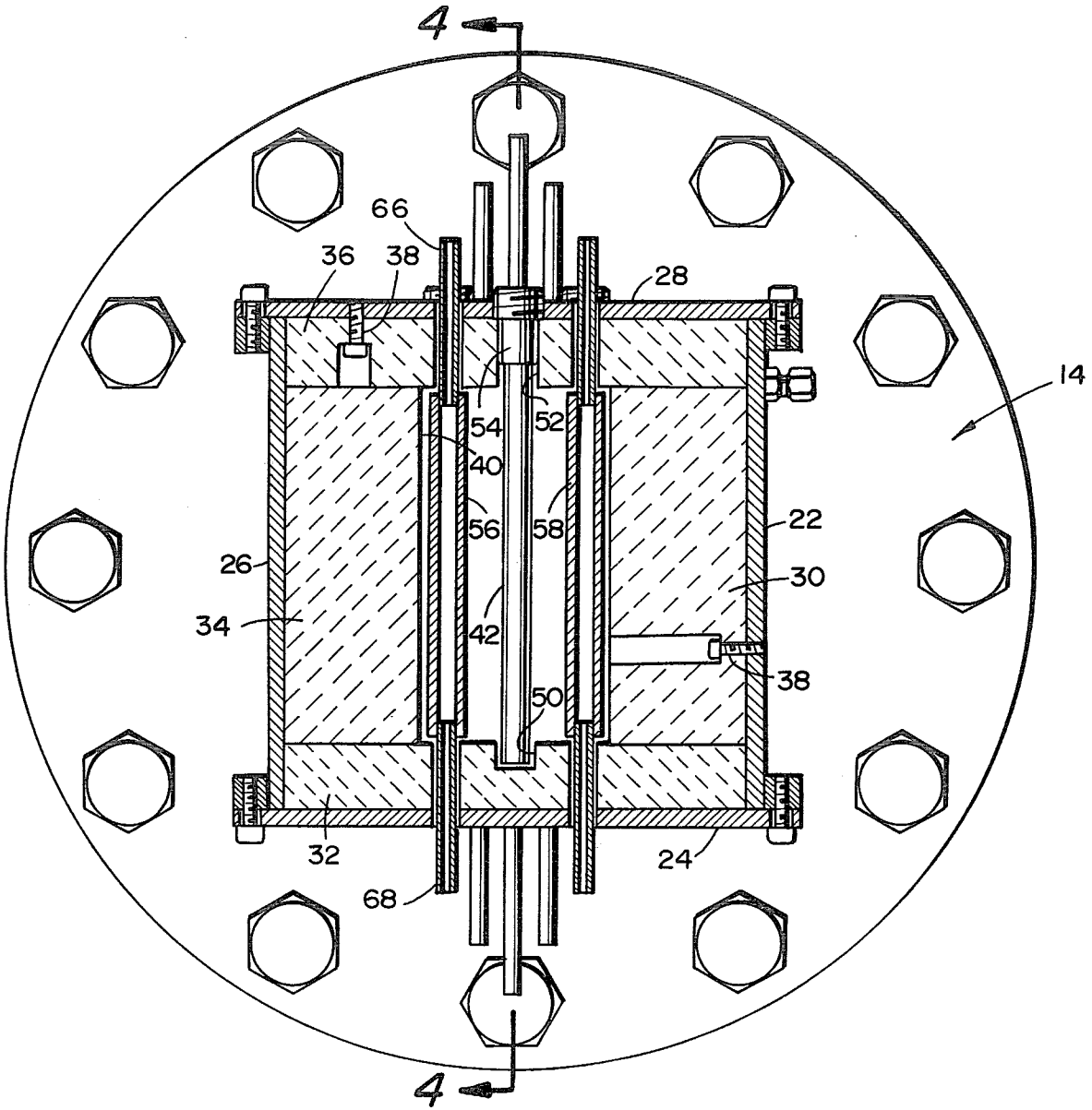
FIG. 3 is a cross-section view taken along the line 3—3 of FIG. 2.
Figure 4:
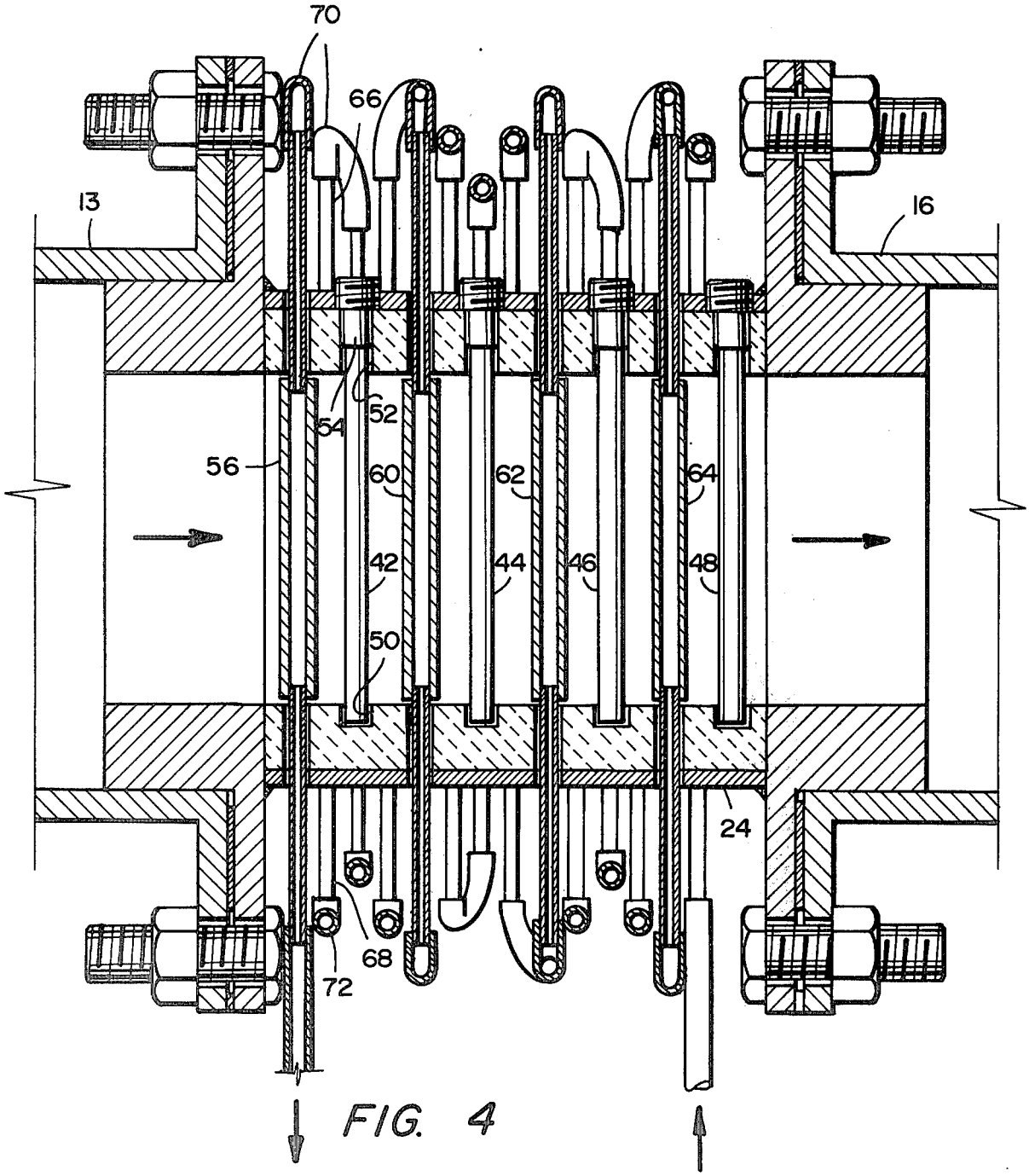
FIG. 4 is a longitudinal section view taken along the line 4—4 of FIG. 3.

Radiative zone 14 is shown in detail in FIGS. 2–4. The housing which confines the zone comprises four plates 22–28 bolted together to form an enclosure which is square in cross-section. Suitable high temperature insulation material such as refractory brick 30–36 is mounted by bolts 38 about the inside of the enclosure so that the brick forms the outer wall of a rectangular cross-section flow passage 40.

A catalytic bed in zone 14 is formed of a plurality of bodies or cylinders 42–48 comprised of a surface-active material, which preferably is deposited in a coating or layer about a ceramic core. The surface-active material selected for the desired application would depend on the particular operating conditions and requirements. The use of a noble metal, such as a platinum system, for the catalyst material provides satisfactory results. The cylinders are mounted in parallel, spaced-apart relationship transversely across the flow passage. Circular recesses 50 formed on one side of the refractory wall seat common ends of the cylinders, and openings 52 formed on the opposite side of the refractory wall seat the other ends of the cylinders. Plugs 54 formed with threaded heads are mounted in openings formed in plate 28 to capture the cylinders in their seats. The plugs are removable for maintenance or replacement of the cylinders.

As best illustrated in FIG. 1 the cylinders 42–48 are uniformly spaced across and along the radiative zone in a manner which provides optimum contact with the gas reactants and at the same time minimal resistance to flow. In the illustrated embodiment the array comprises four transversely mounted cylinders spaced along each of three rows. Other configurations could be provided, for example the cylinders could be mounted to extend lengthwise of the stream. Also the catalytic bodies could be formed in geometric shapes other than cylinders.

Radiant energy heat sinks are mounted within zone 14 in spaced relationship about the catalytic cylinders. In the illustrated embodiment the heat sinks comprises metal conduits or tubes 56–64 which extend parallel with and are arrayed in spaced relationship about the cylinders. As illustrated in FIG. 3, mounting tubes 66, 68 inserted through openings formed in the plates and refractory walls project into and support opposite ends of the conduits. The various mounting tubes are connected in series by flexible hoses 70, 72 for directing a heat exchange medium, such as water, through the conduits. Preferably a pump, not shown, would be provided to pump the water in a circuit through the tubes and conduits and to an external heat exchanger, not shown, at a rate which is controlled accordingly to the particular operating conditions so that the heat removal rate is controlled. As shown in FIG. 1, the heat sink conduits are positioned in a honeycomb-type array so that the cylinders are surrounded by clusters of equally spaced heat sink conduits to achieve an optimum balance between available energy collecting surface versus minimum resistance to stream flow.

The products which discharge from radiative zone 12 are directed through transition zone 16 to adiabatic combustion zone 18. The combustion zone includes a catalytic combustor 74 for completing combustion of the reactants exhausting from the radiative zone. Combustor 74 can be of the type described in the above-referenced application Ser. No. 799,948 now U.S. Pat. No. 4,154,568 and which incorporates monolith catalytic beds of graduated cell size which achieves high combustion efficiency and low emissions under stable combustion conditions.

The stream of products discharging from combustion zone 18 are directed into convective zone 20 for extraction of residual energy. In the convective zone tubing 76 is mounted for carrying a heat exchange medium, such as water, which can be pumped to a suitable external heat exchanger, not shown.

In the process of the invention the system is operated to provide a steady state catalytic cylinder surface temperature below the melt temperature of the catalytic material. The steady state surface temperature for a particular system is calculated by equating, for a cylinder in the combustion zone, the convective energy gain QC to the losses. The convective gain QC is given by the difference between the surrounding adiabatic flame temperature and the wall temperature multiplied by the convective transfer coefficient of the cylinder in cross flow. The radiative transfer QR from the cylinder is a function of the cylinder wall temperature, surrounding water tube wall temperatures, and respective emissivities and absorptivities of the surfaces. The view factor is essentially unity.

In a system of the invention employing the radiative zone configuration of FIG. 1, and assuming a stoichiometric fuel/air ratio with a $2\times10^5$ Btu/hr. heat release rate, the heat flow analysis shows that the catalytic surface temperature is 1,910° F., an acceptable temperature level to prevent meltdown of the catalyst. Calculations are then made to determine: (1) the heat load to the cooling tubes (both radiation and convection) for determining water tube heat removal rates, and (2) refractory thickness to maintain exterior surface temperatures at acceptable values. The heat transfer was calculated to be half radiative and half convective with a total value of 61,000 Btu/hr.-ft$^2$ of tube surface. The refractory was sized at 2" thick sidewalls and 1" thick top and bottom walls for the selected firebrick material.

Examples of the operation of the process and system of the invention are as follows. A combustion system in accordance with the embodiment of FIGS. 1–4 was constructed with the radiative zone internal dimensions of 5.50" high by 2.75" wide. The conduits were sized 0.50" outer diameter by 0.25" inner diameter with water employed as the cooling medium. The cylinders were sized 0.50" outer diameter with the catalytic surface system comprising $Pt/Al_2O_3/Al_2O_3$.

A fuel/air mixture utilizing, in different runs, natural gas or propane fuel was directed at near 1 atm. pressure into the inlet of radiative zone 12 where combustion was initiated about the cylinders 42–48. Tests were conducted with measurements taken under varying operating conditions. The flow rate of the fuel was varied during the tests in the range of 4.6 to 14.8 lbm/hr with the total fuel/air flow rate varied in the range of 35 to 265 lbm/hr. The range of fuel/air stoichiometry was varied in the range of 40% of theoretical air to 220% theoretical air. Preheat or inlet temperature was varied in the range of 225° to 825° F. The typical water flow conditions for the heat sink conduits were 1.0 gpm with a temperature rise of 55° to 75° F.

Figure 5:
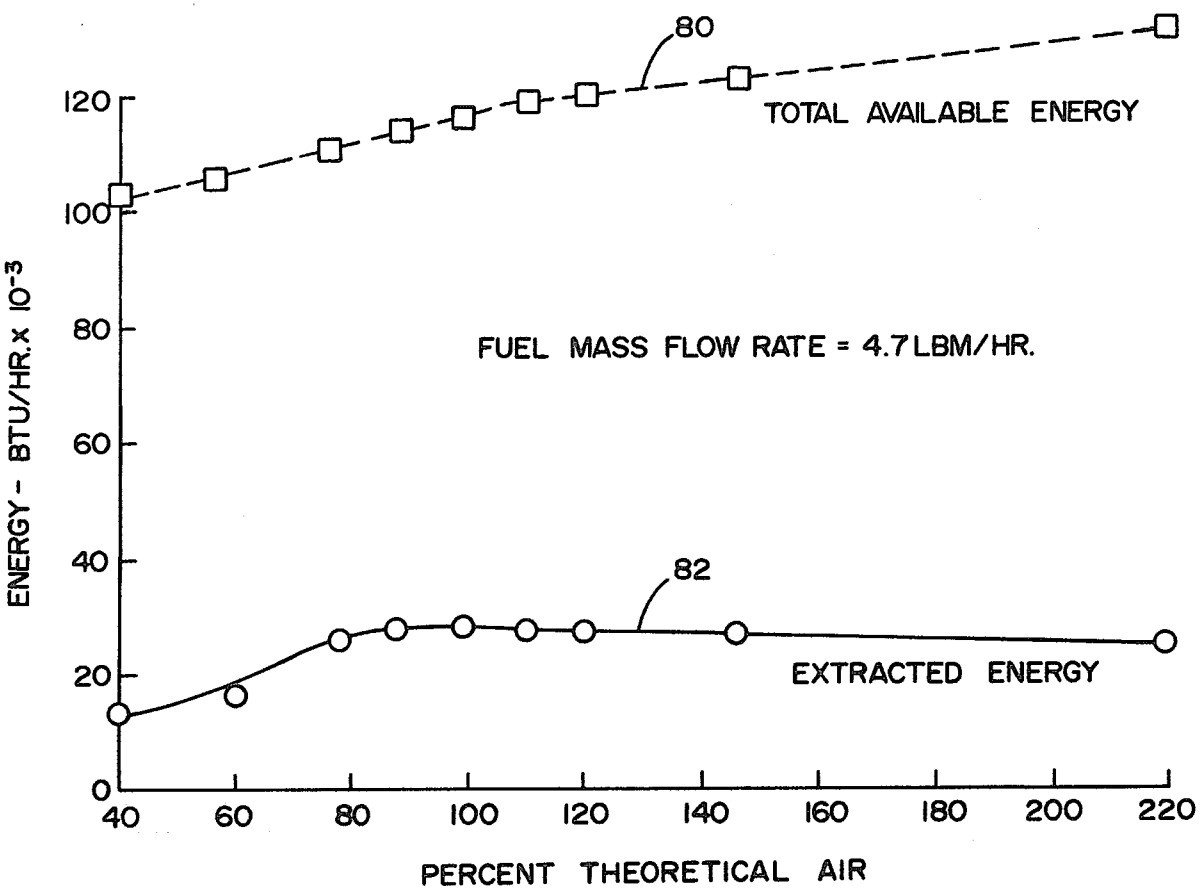
FIGS. 5–9 are graphs illustrating operating results for the process of the invention.
Figure 6:
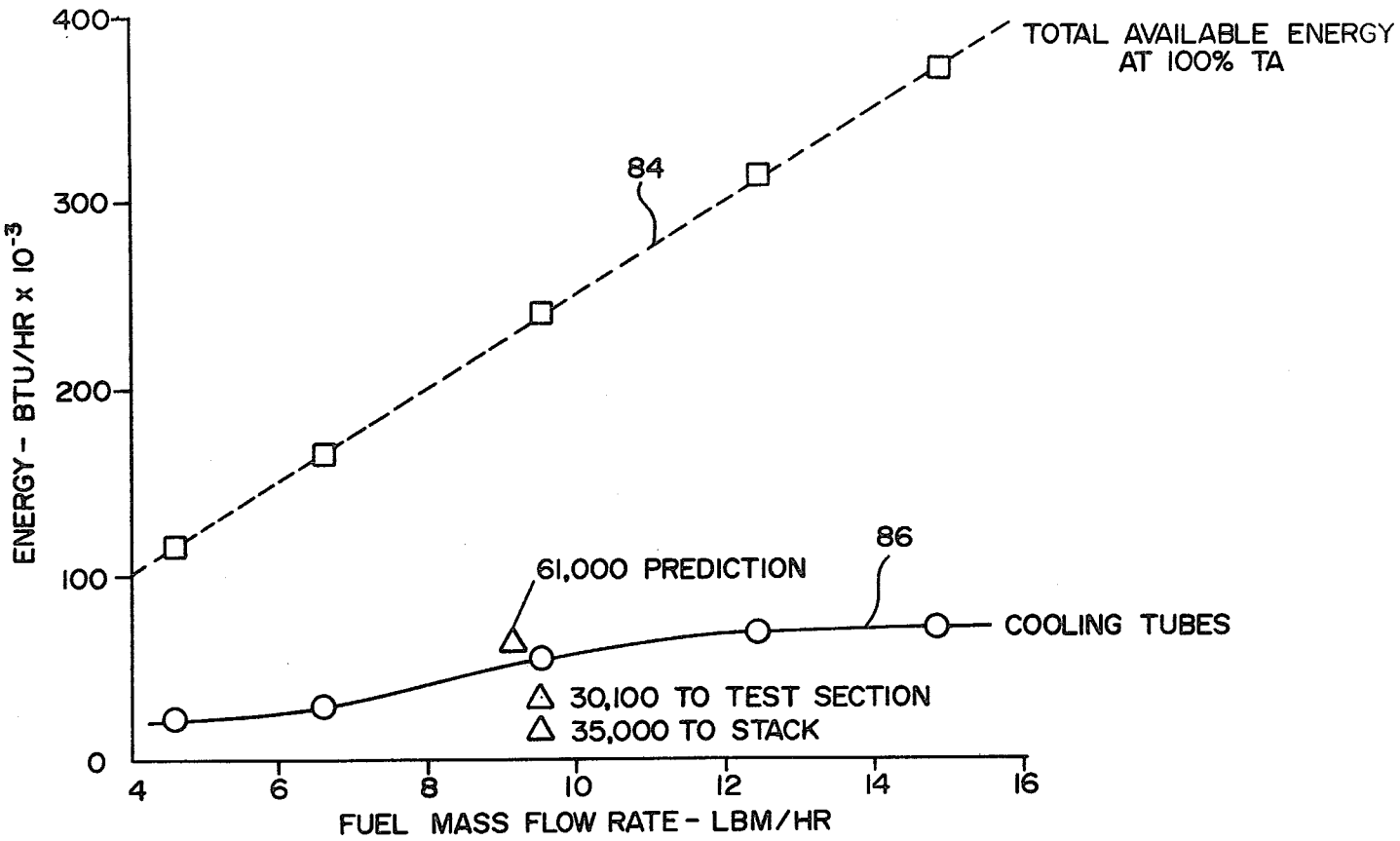

The graphs of FIGS. 5–9 depict the results of the foregoing tests. The graph of FIG. 5 plots radiative system energy release as a function of theoretical air at a fuel mass rate of 4.7 lbm/hr. Curve 80 plots the total available energy at the inlet and curve 82 plots the energy release from the cooling tubes. The graph of FIG. 6 depicts energy release as a function of fuel mass rate throughput, with curve 84 plotting total available energy at 100% theoretical air and curve 86 plotting energy release from the cooling tubes.

Figure 7:
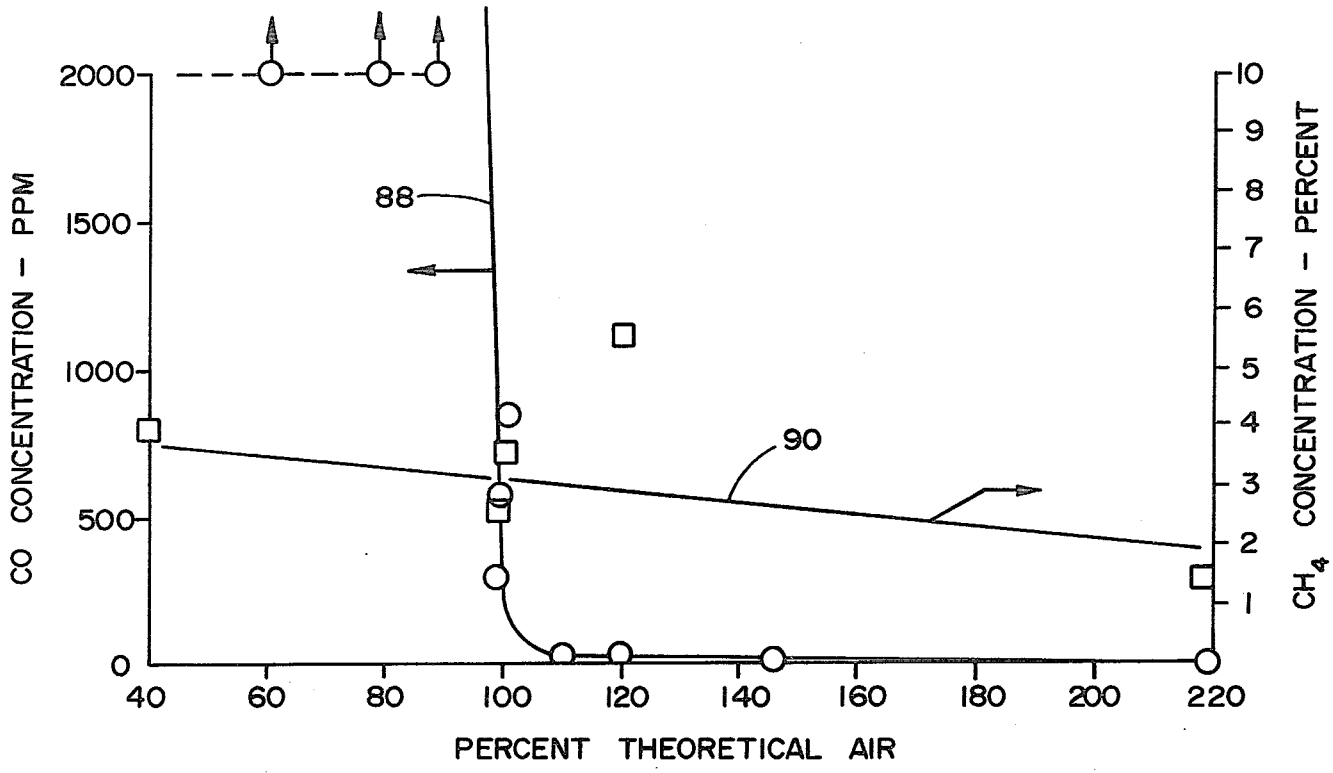
Figure 8:
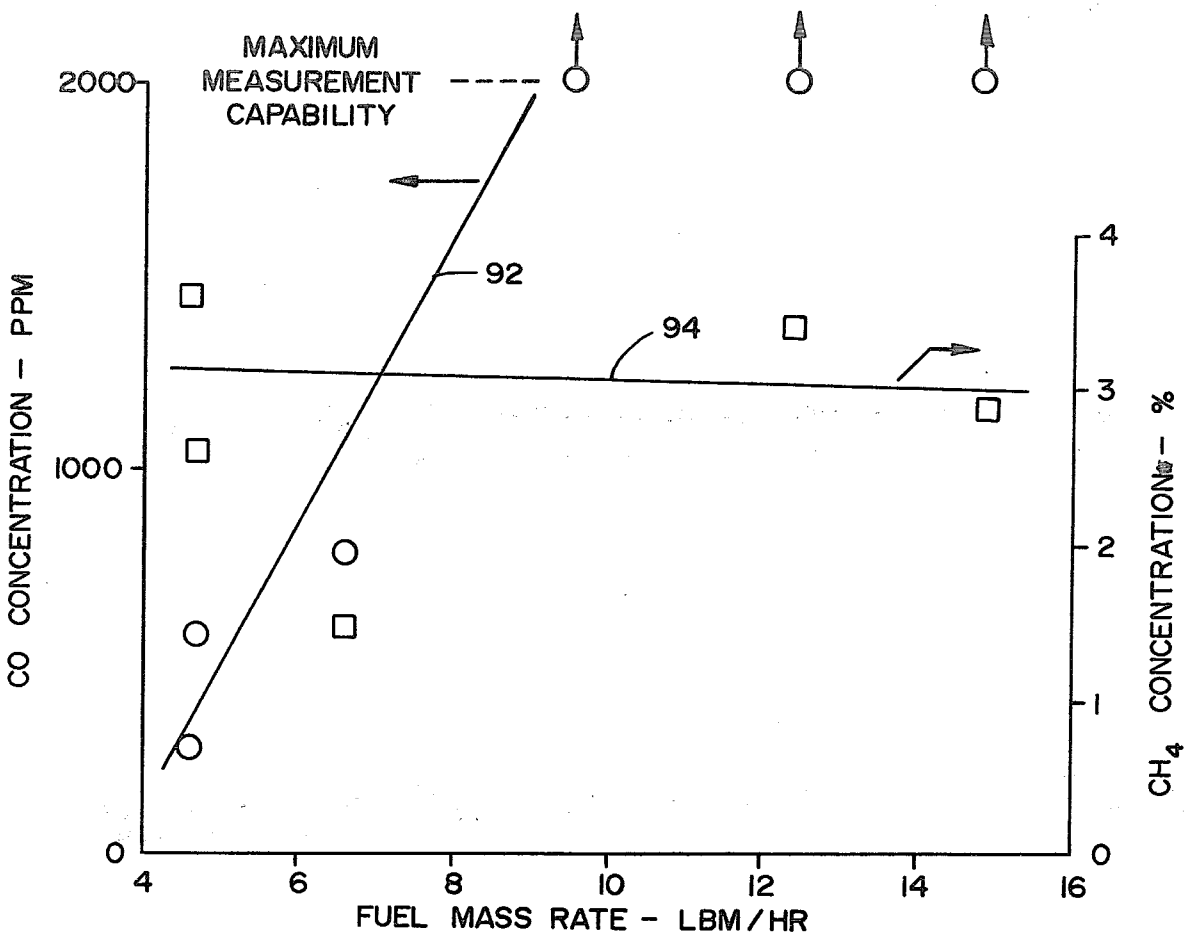

Gas composition at the outlet of radiative zone 12 was measured and showed the following ranges for the various emission components: methane, 1 to 4%; carbon monoxide, 0 to >2000 ppm; hydrogen, 0 to 5%; oxygen, 14 to 19%; carbon dioxide, <0.5%; nitrogen, ≈80%; nitrogen oxides, <2 ppm. The graph of FIG. 7 depicts the concentration of CO and $CH_4$ emissions at the radiative zone outlet as a function of theoretical air, with curve 88 plotting CO and curve 90 plotting $CH_4$. The graph of FIG. 8 depicts CO and $CH_4$ emission concentration at the radiative zone outlet as a function of fuel mass rate throughput at 100% theoretical air. Curve 92 depicts CO concentration while curve 94 depicts $CH_4$ concentration.

Figure 9:
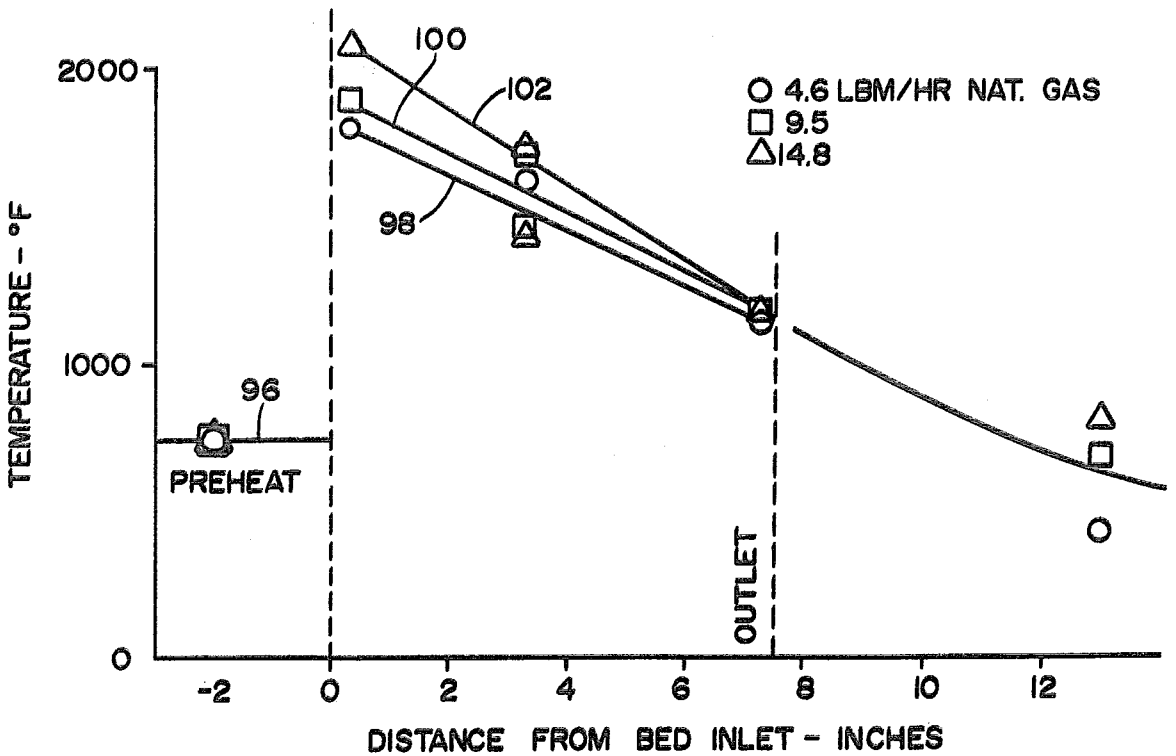

The graph of FIG. 9 depicts the bed temperature profiles as a function of distance in inches from the bed inlet at 100% theoretical air. Curve 96 plots the preheat temperature; curve 98 plots the temperature for natural gas mass rate of 4.6 lbm/hr; curve 100 plots temperature for a flow rate of 9.5 lbm/hr; and curve 102 plots temperature at a flow rate of 14.8 lbm/hr.

It will be realized from the foregoing that operation of the process and system of the invention demonstrates excellent performance at stoichiometric conditions with low emissions of nitrogen oxide. The heat extraction is controlled primarily by the catalyst surface temperature, peaking at approximately 100% theoretical air (stoichiometric). As theoretical air further increases above 100%, surface temperature again begins to decrease, decreasing the radiant exchange. Non-adiabatic operation at stoichiometric conditions in the radiative zone combined with the downstream adiabatic combustion in zone 18 and the energy extraction in convective zone 20 achieves a system which operates at high combustion efficiency with low pollution emissions. The stoichiometric combustion in the radiative zone is achieved by removal of surface energy while maintaining sufficiently high surface temperature for sustaining combustion, a result which would be infeasible with metal-to-ceramic or water-to-ceramic conduction or convective energy transfer because of severe design and material limitations.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A process for combusting fuel and oxidizer reactants, comprising the steps of directing a mixture of the reactants along a zone in which bodies having a surface-active material are disposed, combusting reactants about said bodies, and radiating energy from the bodies to heat sinks which are spaced in an array about each of the bodies within the zone, said energy being radiated to the heat sinks at a rate which prevents the temperature of the material from exceeding a predetermined limit, directing the products from the zone in an exhaust stream along a path through a combustor, and adiabatically combusting exhaust stream reactants in the combustor.

2. A process as in claim 1 in which energy is radiated from the body at a rate which is optimum for maintaining the temperature of the surface-active material below its melting point but at a sufficiently high level for maintaining the combustion.

3. A process as in claim 1 which includes the step of extracting thermal energy from the heat sink at a rate which is controlled for maintaining optimum combustion conditions within the zone.

4. A process as in claim 3 in which the thermal energy is extracted from the heat sink by directing a coolant medium in heat exchange relationship through the heat sink.

5. A process as in claim 1 including the step of directing products from the combustor in a discharge stream, and extracting thermal energy from the discharge stream.

6. A combustor for combusting fuel and oxidizer reactants comprising the combination of means forming a flow passage for confining a stream of the reactants, means forming a plurality of surface-active bed elements within the passage for establishing combustion of the reactants, means forming a radiant energy heat sink within the passage spaced about the elements of the bed for absorbing radiant energy from the bed at a rate sufficient to maintain the temperature of the bed below a predetermined value, means for directing products from the combustion around the surface-active bed along an outlet stream, and an adiabatic combustor in the outlet stream for adiabatically combusting reactants in the products of the outlet stream.

7. A combustor as in claim 6 in which the heat sink means includes flow channel means for directing a coolant fluid in heat exchange relationship through the heat sink means for extracting energy therefrom.

8. A combustor as in claim 7 in which the heat sink means comprises a plurality of conduits disposed in a spaced-apart array about or among the surface active bed.

9. A combustor as in claim 8 in which the bed comprises a plurality of cylinders, the outer surfaces of which are surface-active.

10. A combustor as in claim 9 in which each cylinder is surrounded by a plurality of circumferentially spaced conduits extending parallel with the cylinder.

11. A combustor as in claim 9 in which the conduits and cylinders extend across the flow passage transversely of the reactant stream.

12. A combustor as in claim 9 in which an array of the conduits are equally spaced about each cylinder.

13. A combustor as in claim 6 in which the bed comprises a plurality of parallel, transversely spaced-apart elongate members mounted in the passage with the reactant stream flowing around and between the members.

14. A combustor as in claim 13 which includes a catalyst on the outer surfaces of the bed members.

15. A system of apparatus for combusting air and fuel reactants comprising the combination of means for directing a mixture of the reactants along a flow path, a first catalytic combustor bed in an upstream zone of the flow path for combusting reactants in the stream, means forming a surface within the upstream zone spaced from the bed for absorbing radiant energy therefrom at a rate which maintains the temperature of the bed below a predetermined level, and a second catalytic combustor bed in a downstream zone of the flow path for adiabatically combusting reactants in the stream exhausting from the upstream zone.

16. A system as in claim 15 which includes means for directing a coolant medium in heat exchange relationship with the energy absorbing surface for extracting thermal energy therefrom.

17. A system as in claim 15 which includes means for directing a coolant medium in heat exchange relationship with products in the stream emerging from the second combustor for extracting thermal energy from such products.

* * * * *